US006811414B1

(12) United States Patent
Consoli et al.

(10) Patent No.: US 6,811,414 B1
(45) Date of Patent: Nov. 2, 2004

(54) ELECTRICAL CONNECTOR MODULE WITH MULTIPLE CARD EDGE SECTIONS

(75) Inventors: John Joseph Consoli, Harrisburg, PA (US); James Lee Fedder, Etters, PA (US); Alexander William Hasircoglu, Columbia, PA (US); John Thomas Larkin, Jr., Camp Hill, PA (US); Lynn Robert Sipe, Mifflintown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/439,701

(22) Filed: May 16, 2003

(51) Int. Cl.[7] ..... H01R 13/502
(52) U.S. Cl. ..... 439/79; 439/65
(58) Field of Search ..... 439/79, 80, 65, 439/608

(56) References Cited

U.S. PATENT DOCUMENTS

| | | | | | |
|---|---|---|---|---|---|
| 4,647,123 | A | * | 3/1987 | Chin et al. | 439/61 |
| 5,192,220 | A | * | 3/1993 | Billman et al. | 439/327 |
| 5,326,276 | A | * | 7/1994 | Cheng | 439/326 |
| 5,690,504 | A | * | 11/1997 | Scanlan et al. | 439/378 |
| 6,179,664 | B1 | * | 1/2001 | Tung et al. | 439/633 |
| 6,267,604 | B1 | | 7/2001 | Mickievicz et al. | |
| 6,409,543 | B1 | * | 6/2002 | Astbury et al. | 439/608 |

* cited by examiner

*Primary Examiner*—Neil Abrams

(57) ABSTRACT

An electrical connector is disclosed having a housing with first and second sides configured to be joined to first and second circuit boards, respectively. The electrical connector also includes a wafer held in the housing. The wafer has first and second card edges and has electrical traces extending between the first and second card edges. The first card edges are divided into upper and lower sections configured to be received in separate upper and lower connectors mounted on the first circuit board.

20 Claims, 9 Drawing Sheets

ELECTRICAL CONNECTOR MODULE WITH MULTIPLE CARD EDGE SECTIONS

BACKGROUND OF THE INVENTION

The present invention generally relates to an electrical connector module for connecting circuit boards. More particularly, certain embodiments of the present invention relate to an electrical connector module that is divided into sections to engage a plurality of connectors provided on one of a daughter card and a backplane board.

Various electronic systems, such as computers, comprise a wide array of components mounted on printed circuit boards, such as daughter cards, backplane boards, motherboards, and the like which are interconnected to transfer power and data signals throughout the systems. Typical connector assemblies include a backplane connector attached to a backplane board and a daughter card connector that is attached to the daughter card. The backplane and daughter card connectors are joined to electrically connect the backplane board to the daughter card. The daughter cards are often aligned othogonally to the backplane board and parallel to each other.

Conventional daughter card connectors include organizers carrying wafers with bottom and front card edges. The bottom card edges are configured to engage the daughter card and the front card edges are configured to engage the backplane connector, in order to carry electrical signals between the daughter card and the backplane board.

In order to process a large number of electrical signals at a high speed while taking up minimal space within the computer, two adjacent daughter cards connected to the backplane board are electrically connected to each other as well. Each daughter card has power and signal interconnects mounted thereon. The power and signal interconnects of adjacent daughter cards are connected to each other by electrical bus jumpers. The daughter cards are also connected to each other by support structures. By electrically connecting adjacent daughter cards, the connected daughter cards are able to process more electrical signals from the backplane board at a faster rate.

However, conventional daughter card connector arrangements suffer from several drawbacks. First, conventional connectors use two separate daughter card connectors with two separate and interconnected daughter cards, thereby taking up considerable space within the computer and requiring numerous interconnecting parts. It is difficult and expensive to assemble and connect so many interconnecting parts between the daughter cards and between each daughter card and daughter card connector. For example, each daughter card must be exactly aligned with the other daughter card in order to then connect the daughter cards. Additionally, the interconnecting parts have different connection tolerances, which make it difficult to assemble daughter cards and connectors in precise alignment. Further, the use of multiple interconnected electrical parts impedes the efficient transfer of electrical signals. Electrical signals often travel from the backplane board through a first daughter card connector to a first daughter card, through the interconnects and bus jumpers to the next daughter card and then back through a second daughter card connector to the backplane board. Thus, the use of so many connecting parts subjects the electrical signals to varying geometries and impedances which may reduce the speed of signal processing and may cause signal reflection.

A need exists for an improved electrical connector for connecting daughter cards to a backplane board.

BRIEF DESCRIPTION OF THE INVENTION

Certain embodiments of the present invention include an electrical connector having a housing with first and second sides configured to be joined to first and second circuit boards, respectively. The electrical connector also includes a wafer held in the housing. The wafer carries electrical traces that extend between first and second card edges. The first card edge has upper and lower sections that are configured to be received in separate upper and lower connectors mounted on the first circuit board.

Certain embodiments of the present invention include an electrical connector configured to mate with at least two separate connectors mounted on a common circuit board. The electrical connector includes a housing having a first side configured to be mounted to the circuit board. The electrical connector also includes a wafer held in the housing. The wafer has a first card edge located proximate the first side of the housing. The electrical connector further includes a shroud mounted to the housing. The shroud has at least one mating interface configured to receive at least two separate and distinct connectors that are mounted on the circuit board.

Figure 1:
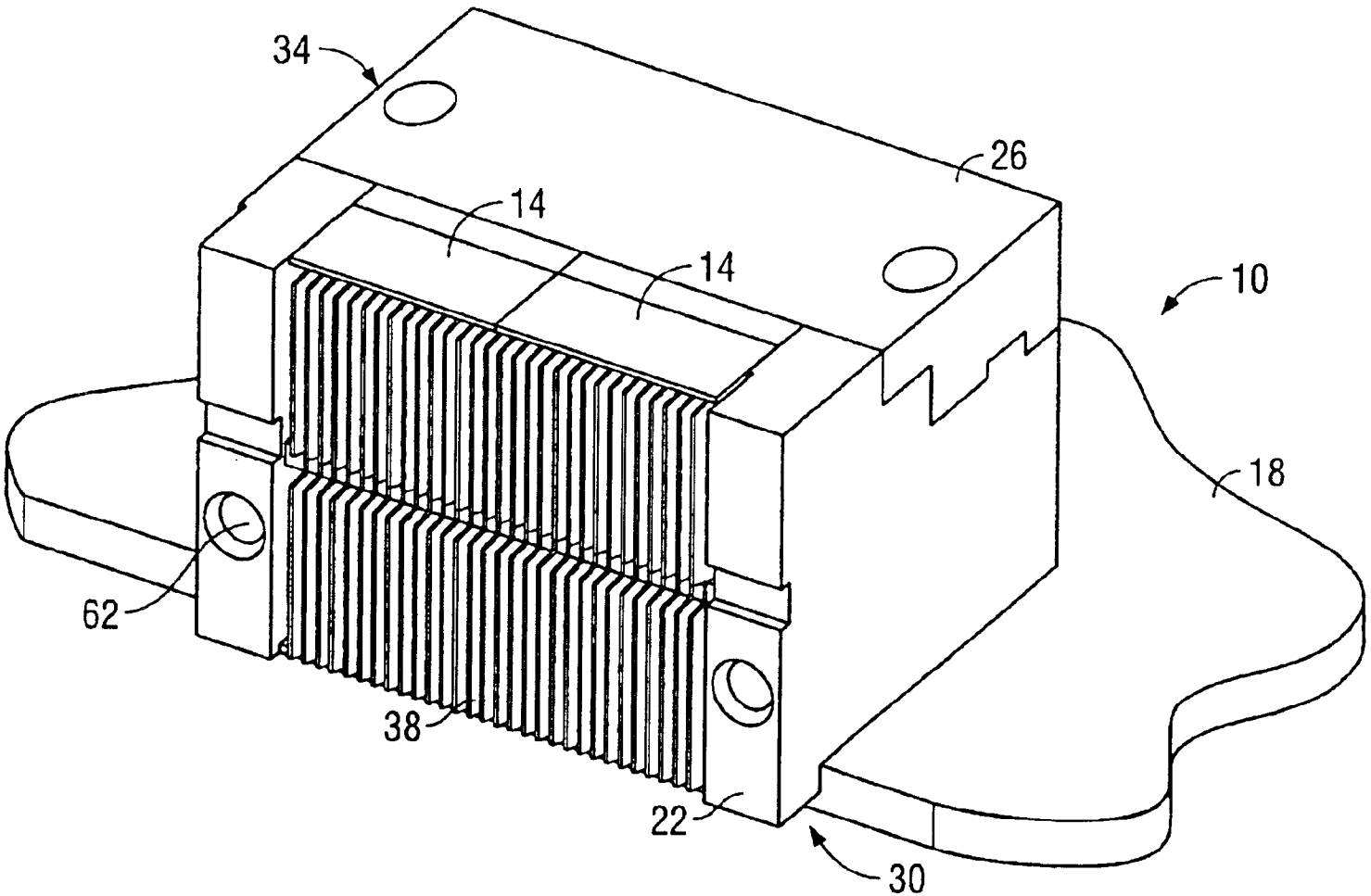
FIG. 1 illustrates an isometric view of a card connector assembly formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates an isometric view of a card connector assembly 10 formed according to an embodiment of the present invention. The card connector assembly 10 includes connector modules 14 connected to a planar daughter card 18 at a bottom side 30 of the card connector assembly 10. The connector modules 14 are located between guide blocks 22 that are also connected to the daughter card 18 at the bottom side 30. The guide blocks 22 have cylindrical apertures 62. A stiffening bar 26 is fastened to the guide blocks 22 at a top side 34 of the card connector assembly 10 to secure the guide blocks 22 and connector modules 14 together. The connector modules 14 carry rows of parallel wafers 38 that carry electrical power and data signals to and from the daughter card 18.

Figure 2:
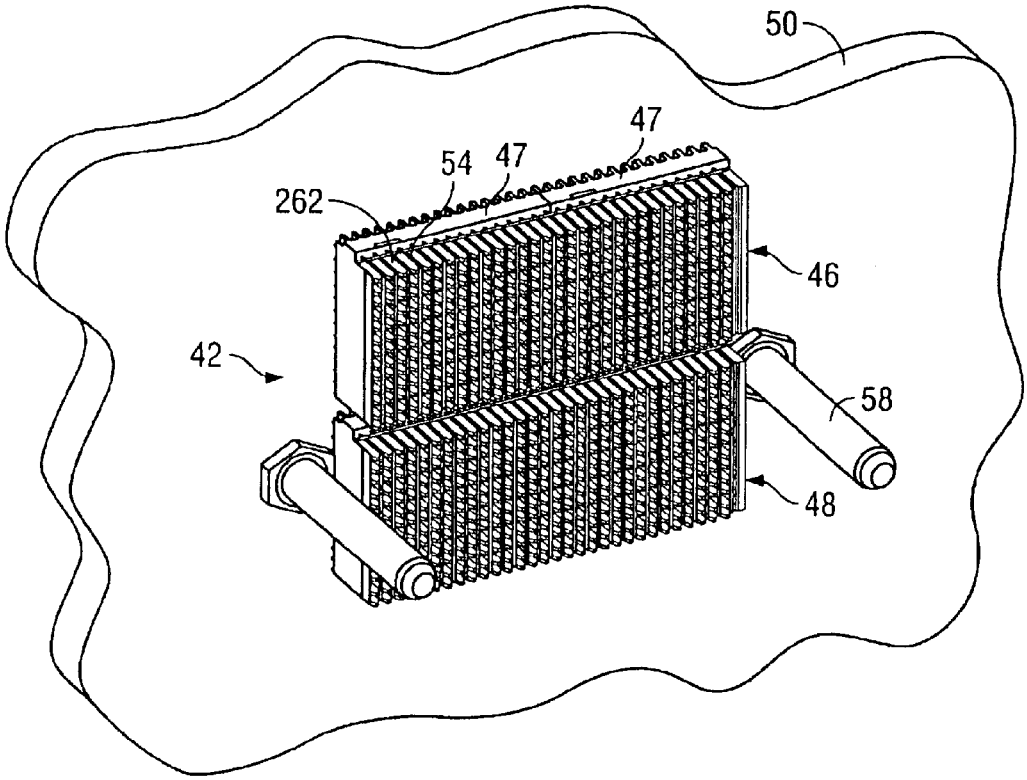
FIG. 2 illustrates an isometric view of a backplane connector assembly formed according to an embodiment of the present invention.

FIG. 2 illustrates an isometric view of a backplane connector assembly 42 formed according to an embodiment of the present invention. The backplane connector assembly 42 includes parallel upper and lower backplane connectors 46 and 48 connected to a planar backplane board 50. The upper and lower backplane connectors 46 and 48 include backplane connector modules 47 arranged next to each other. The backplane connector modules 47 have parallel vertical slots 54 separated by divider walls 262.

Figure 8:
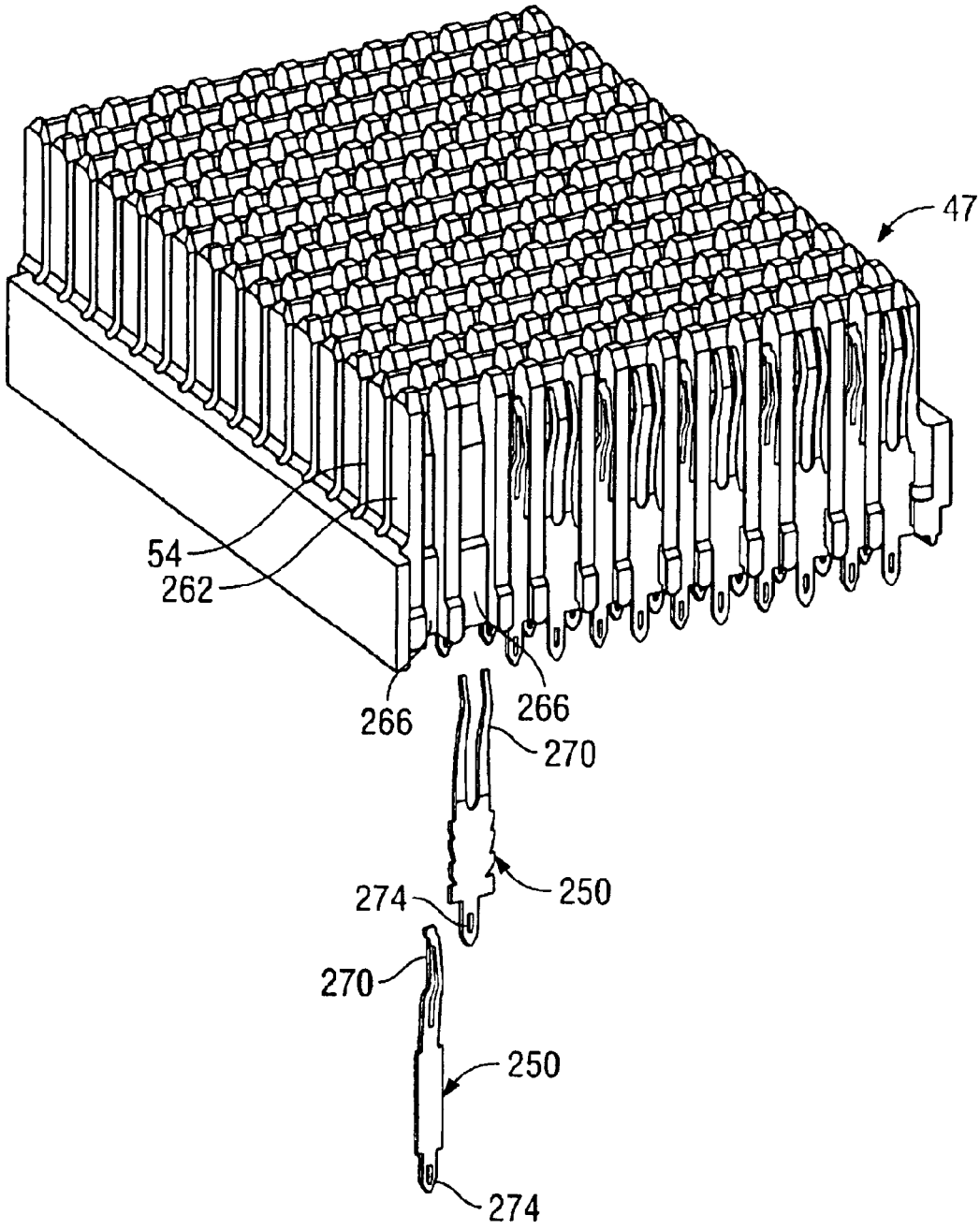
FIG. 8 illustrates a cutaway, partially exploded isometric view of a backplane connector module formed according to an embodiment of the present invention.

FIG. 8 illustrates a cutaway, partially exploded isometric view of a backplane connector module 47. The divider walls 262 each have a series of gaps 266 that carry contacts 250 in the slots 54. Each contact 250 has prongs 270 extending from a first end and a flexible pin 274 extending from an opposite second end. The prongs 270 extend into the slots 54 and the pins 274 are press fitted into throughholes in the backplane board 50 (FIG. 2).

Returning to FIG. 2, the backplane connector assembly 42 and card connector assembly 10 (FIG. 1) are configured to be mated with each other such that the slots 54 receive the wafers 38 (FIG. 1) extending from the connector modules 14 (FIG. 1). The prongs 270 (FIG. 8) of the contacts 250 (FIG. 8) engage the wafers 38 to electrically connect the backplane board 50 to the daughter card 18 (FIG. 1). The daughter card 18 is oriented orthogonally with respect to the backplane board 50. Guide posts 58 extend perpendicularly from the backplane board 50 and are received within the apertures 62 (FIG. 1) in the guide blocks 22 (FIG. 1) to retain and support the connector modules 14 in a mating position with the upper and lower backplane connectors 46 and 48.

Figure 3:
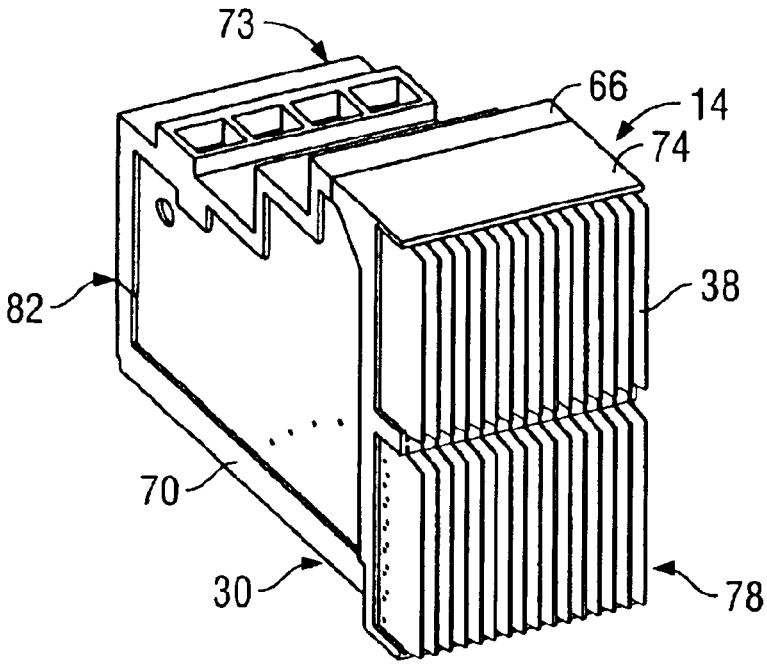
FIG. 3 illustrates a top isometric view of a connector module formed according to an embodiment of the present invention.

FIG. 3 illustrates a top isometric view of a connector module 14 formed according to an embodiment of the present invention. The wafers 38 are carried in a housing 73 that includes a plastic upper organizer 66 and a plastic lower organizer 70 connected to each other at a rear end 82. The housing 73 also includes a plastic shroud 74 that is mounted to the front ends of the upper and lower organizers 66 and 70. The wafers 38 extend through the shroud 74 to project from a front side 78 of the connector module 14. The housing 73 has a first mating face on the front side 78 that engages the upper and lower backplane connectors 46 and 48 (FIG. 2). The housing has a second mating face at the bottom side 30 that engages the daughter card 18 (FIG. 1).

Figure 4:
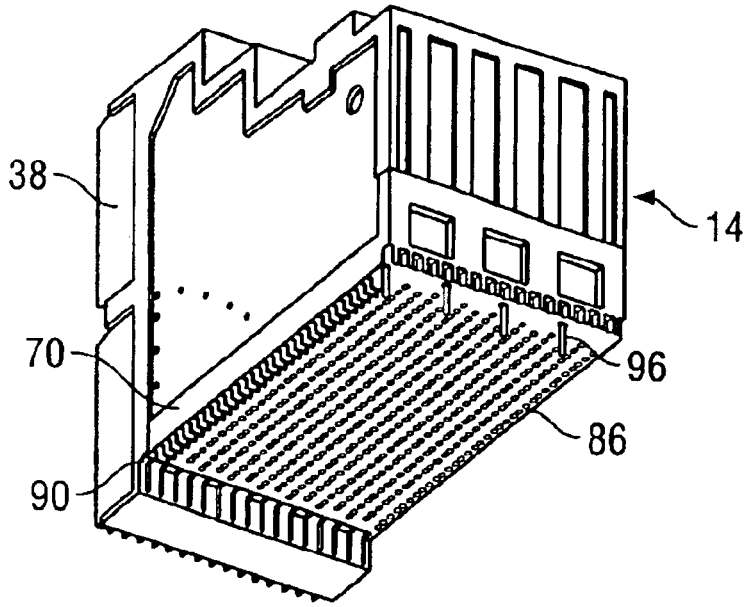
FIG. 4 illustrates a bottom isometric view of the connector module of FIG. 3.

FIG. 4 illustrates a bottom isometric view of the connector module 14. The lower organizer 70 has an array of holes 86 that receive contacts 90. The contacts 90 extend into the lower organizer 70 to engage the wafers 38. The contacts 90 are press fitted into holes in the daughter card 18 (FIG. 1). The contacts 90 engage electrical traces in the daughter card 18 and bottom contact pads 122 (FIG. 5) on the wafers 38 to electrically connect the wafers 38 to the daughter card 18. The lower organizer 70 also has posts 96 that are received in the daughter card 18 to secure the connector module 14 to the daughter card 18.

Figure 5:
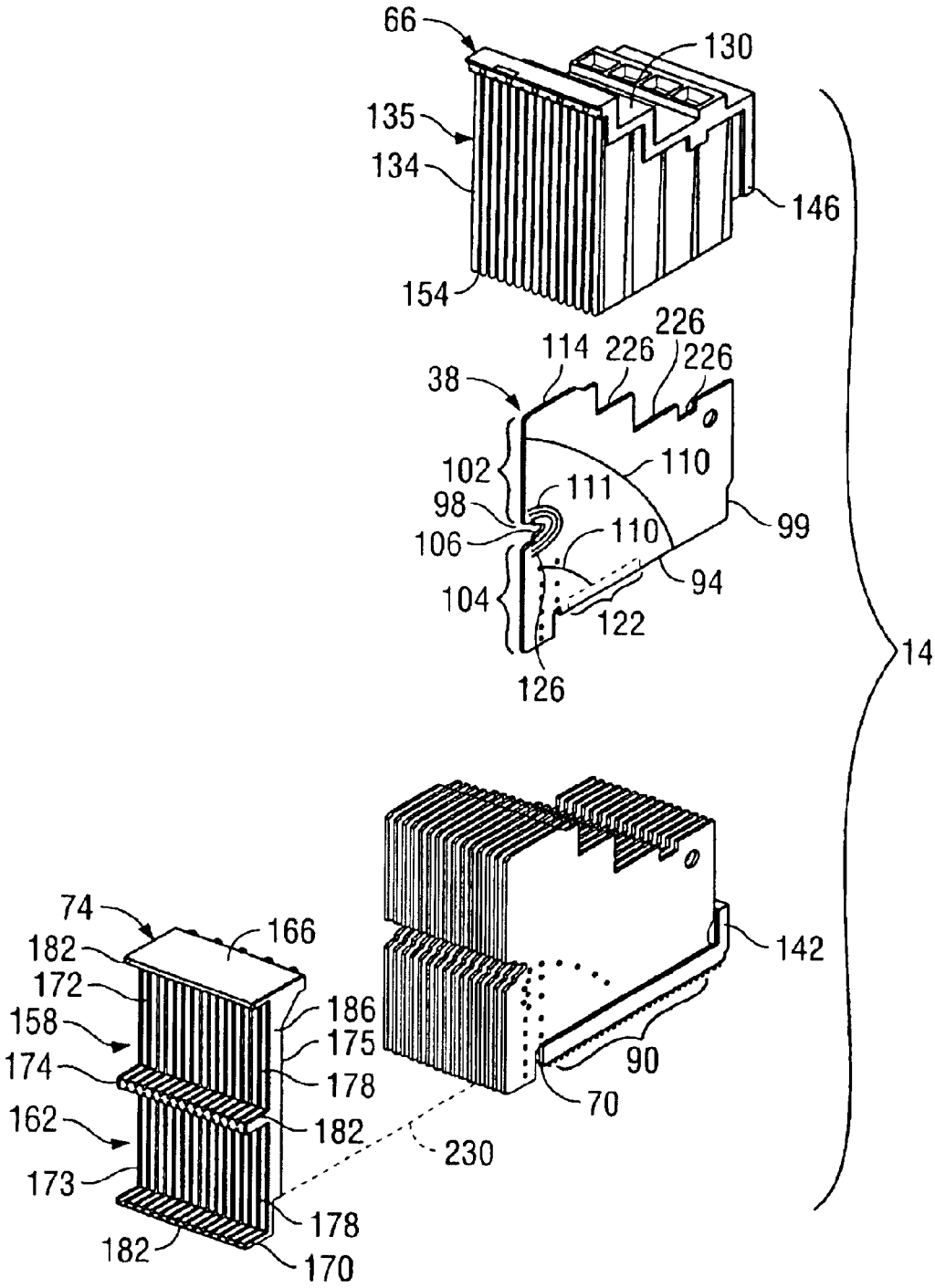
FIG. 5 illustrates a partially exploded isometric view of the connector module of FIG. 3.

FIG. 5 illustrates a partially exploded isometric view of the connector module 14 of FIG. 3. The wafers 38 have thin, planar bodies with bottom card edges 94, front card edges 98 and back edges 99. The bottom card edges 94 and front card edges 98 are orthogonal to each other. At the front card edge 98, each wafer 38 has upper and lower sections 102 and 104. In the embodiment of FIG. 5, the upper and lower sections 102 and 104 are divided by a notch 106. Optionally, the upper and lower sections 102 and 104 may be provided along a uniform, straight first card edge 98 with no notch 106. Optionally, the upper and lower sections 102 and 104 may be staggered in different planes and/or oriented at an acute or obtuse angle to one another.

The wafers 38 have bottom contact pads 122 along the bottom card edge 94 and front contact pads 126 along the front card edge 98. Electrical traces 110 extend between the bottom contact pads 122 and the front contact pads 126. Traces 111 extend between front contact pads 126 in the upper and lower sections 102 and 104 of the front card edge 98. The electrical traces 110 are thus configured to join the daughter card 18 (FIG. 1) with the upper and lower backplane connectors 46 and 48 (FIG. 2). Optionally, the bottom contact pads 122 and the front contact pads 126, and/or front contact pads 126 in the upper and lower sections 102 and 104, may be connected by solid copper layers to carry power signals therebetween. Each wafer 38 also has a series of rectangular cutouts 226 along a top edge 114.

Figure 6:
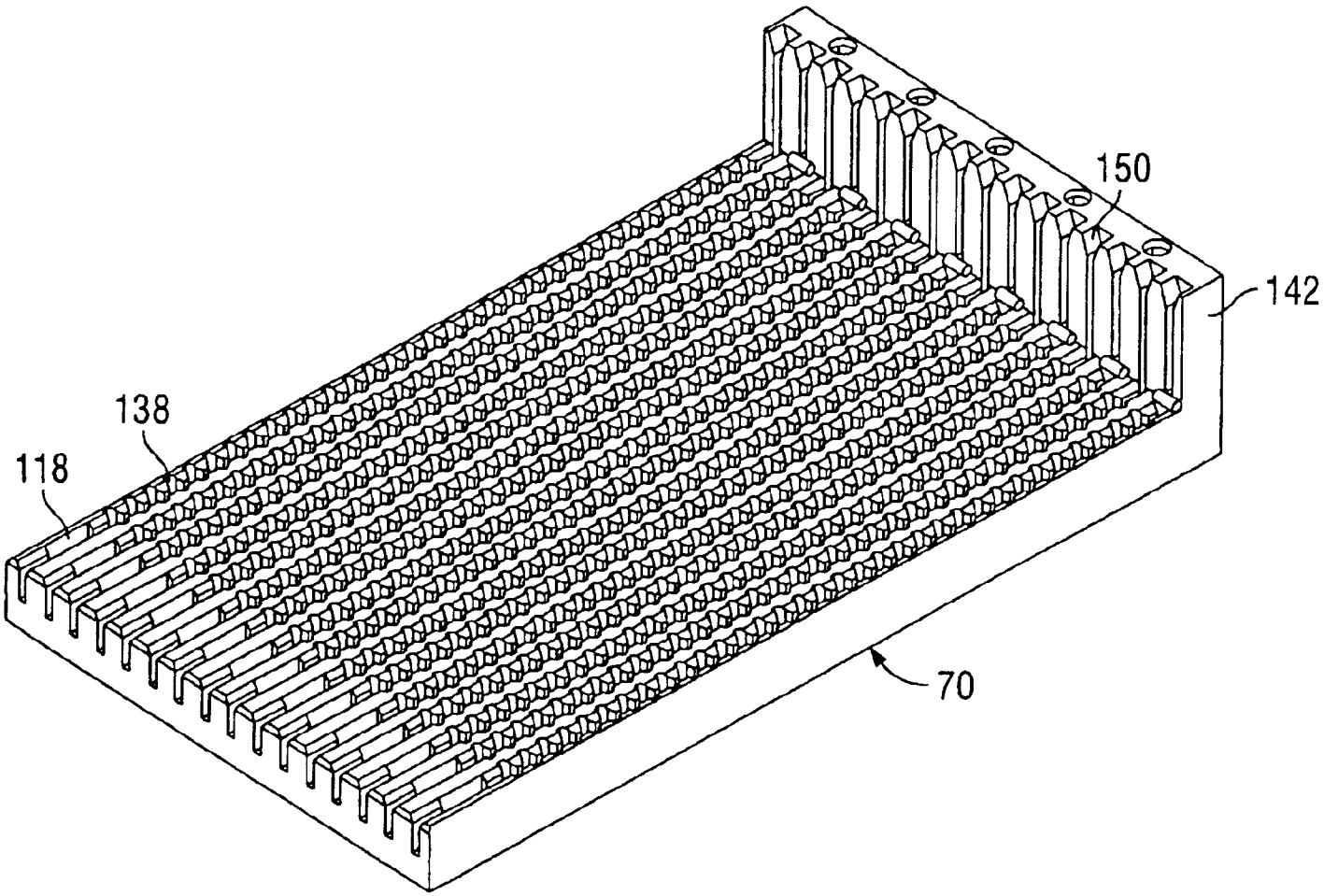
FIG. 6 illustrates an isometric view of a lower organizer formed according to an embodiment of the present invention.

FIG. 6 illustrates an isometric view of the lower organizer 70 which includes parallel channels 118 extending along the length of the lower organizer 70. Each channel 118 includes notches 138 extending transversely through the channel 118. Each channel 118 receives a corresponding wafer 38 (FIG. 5) and the notches 138 hold the contacts 90 (FIG. 4) that engage the bottom contact pads 122 (FIG. 5) along the wafer 38. The lower organizer 70 also includes a rear wall 142 having channels 150 that are configured to receive a portion of the back edge 99 (FIG. 5) of the wafer 38. The rear wall 142 engages the upper organizer 66 (FIG. 5) when the lower and upper 70 and 66 organizers are connected together.

Figure 11:
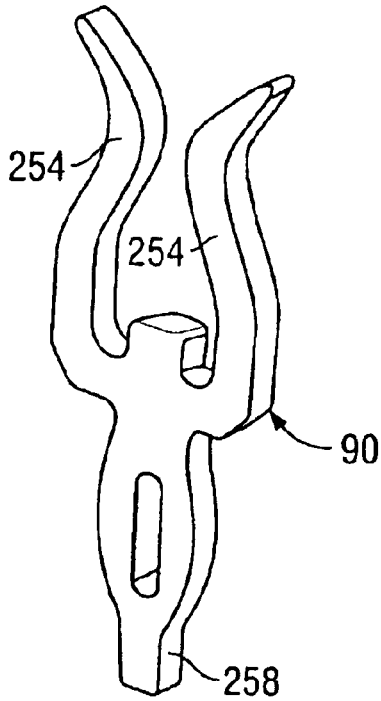
FIG. 11 illustrates an isometric view of a contact formed according to an embodiment of the present invention.

FIG. 11 illustrates an isometric view of a contact 90 formed according to an embodiment of the present invention. The contact 90 has two prongs 254 formed with a pin 258. The contact 90 is inserted in the lower organizer 70 (FIG. 6) such that the pin 258 extends through a hole 86 (FIG. 4) in the lower organizer 70 and the prongs 254 are received in the notches 138 (FIG. 6) in the lower organizer 70. The prongs 254 are thus located proximate a channel 118 (FIG. 6).

Returning to FIG. 5, the wafers 38 are inserted into the lower organizer 70 with the bottom card edges 94 being received in the parallel channels 118 (FIG. 6). The wafers 38 are received between the prongs 254 (FIG. 11) of the contacts 90 and the prongs 254 engage the bottom contact pads 122 along the bottom card edges 94 of the wafers 38. The pins 258 (FIG. 11) of the contacts 90 are then press fitted into the daughter card 18 (FIG. 1).

The upper organizer 66 includes a top wall 130 that is formed in a stepped manner to fit along the top edges 114 of the wafers 38 and extend into the cutouts 226 of the wafers 38. Parallel spacer ribs 134 are formed with, and extend perpendicularly from, the top wall 130 to define parallel wafer slots 154 therebetween. The spacer ribs 134 may be made of a rigid plastic material. A rear wall 146 is formed with, and extends perpendicularly downward from, the top wall 130 along a rear end of the spacer ribs 134. The upper organizer 66 includes an open face 135 provided opposite to the rear wall 146. In assembly, the upper organizer 66 is connected to the lower organizer 70 such that the wafers 38 are received in the wafer slots 154 between the spacer ribs 134 and the rear wall 146 of the upper organizer 66 engages the rear wall 142 of the lower organizer 70. The top wall 130 extends into the cutouts 226 of the wafers 38 to prevent the wafers 38 from sliding along a longitudinal axis 230 within the lower organizer 70. The spacer ribs 134 rest on the lower organizer 70 to support the upper organizer 66 without placing pressure on the wafers 38. Additionally, when the connector module 14 is connected to the daughter card 18 (FIG. 1), the spacer ribs 134 prevent the wafers 38 from bowing under the forces applied to the connector module 14 to press fit the contacts 90 into the daughter card 18.

The shroud 74 is rectangular and has an upper wall 166, a lower wall 170 and an insulated spacer block 174 spaced apart from one another to define separate horizontal channels 172 and 173 that extend across the width of the shroud 74 transverse to an orientation of the wafers 38. The shroud 74 has an upper mating face 158 located between the upper wall 166 and the spacer block 174 and a lower mating face 162 located between the lower wall 170 and the spacer block 174. The upper and lower mating faces 158 and 162 both have parallel vertical tab slots 178 extending through the shroud 74 from the channels 172 and 173 to a rear side 175. The tab slots 178 are oriented vertically to extend between the upper wall 166, the lower wall 170, and the spacer block 174. The upper wall 166, lower wall 170, and spacer block 174 are all connected to one another by side strips 186. In assembly, once the wafers 38 are secured between the upper and lower organizers 66 and 70, the shroud 74 is connected to the connector module 14 at the open face 135 of the upper organizer 66. The upper and lower sections 102 and 104 of the front card edge 98 extend through the tab slots 178 into the channels 172 and 173 at the upper and lower mating faces 158 and 162, respectively. The upper sections 102 slide through slots 182 in the upper wall 166 and spacer block 174, while the lower sections 104 slide through slots 182 in the lower wall 170 and the spacer block 174. The upper wall 166 on the shroud 74 snapably engages the top wall 130 of the upper organizer 66 and the side strips 186 snapably engage the lower organizer 70. Thus, the shroud 74 retains the connector module 14 together and is held orthogonal to the lower organizer 70.

Figure 7:
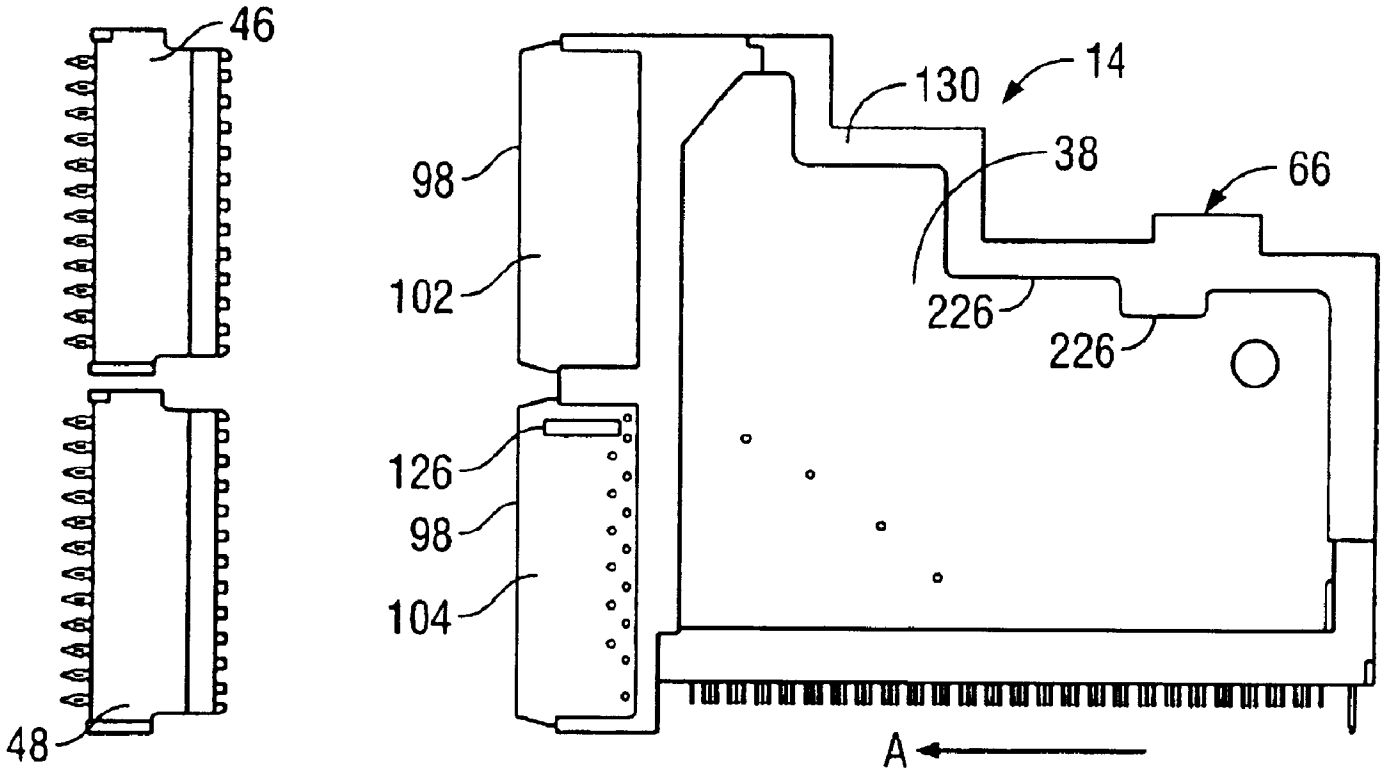
FIG. 7 illustrates a side view a connector module aligned with parallel rows of backplane connectors formed according to an embodiment of the present invention.

FIG. 7 illustrates a side view a connector module 14 aligned with parallel upper and lower backplane connectors 46 and 48. In assembly, the connector module 14 is connected to the upper and lower backplane connectors 46 and 48 by moving the connector module 14 in the direction of arrow A until the upper and lower sections 102 and 104 of the wafers 38 are received in the slots 54 (FIG. 2) of corresponding upper and lower backplane connectors 46 and 48. The contacts 250 (FIG. 8) in the slots 54 engage the front contact pads 126 on the front card edges 98 of the wafers 38. The top wall 130 of the upper organizer 66 engages the cutouts 226 of the wafers 38 to prevent the wafers 38 from being pushed away from the slots 54 due to the friction of inserting several wafers 38 at once into the upper and lower backplane connectors 46 and 48. When the upper and lower sections 102 and 104 are fully inserted into the slots 54, the daughter card 18 (FIG. 1) is electrically connected to the backplane board 50 (FIG. 2). Thus, a single connector module 14 may be used with multiple parallel upper and lower backplane connectors 46 and 48 to connect the daughter card 18 to the backplane board 50.

Figure 9:
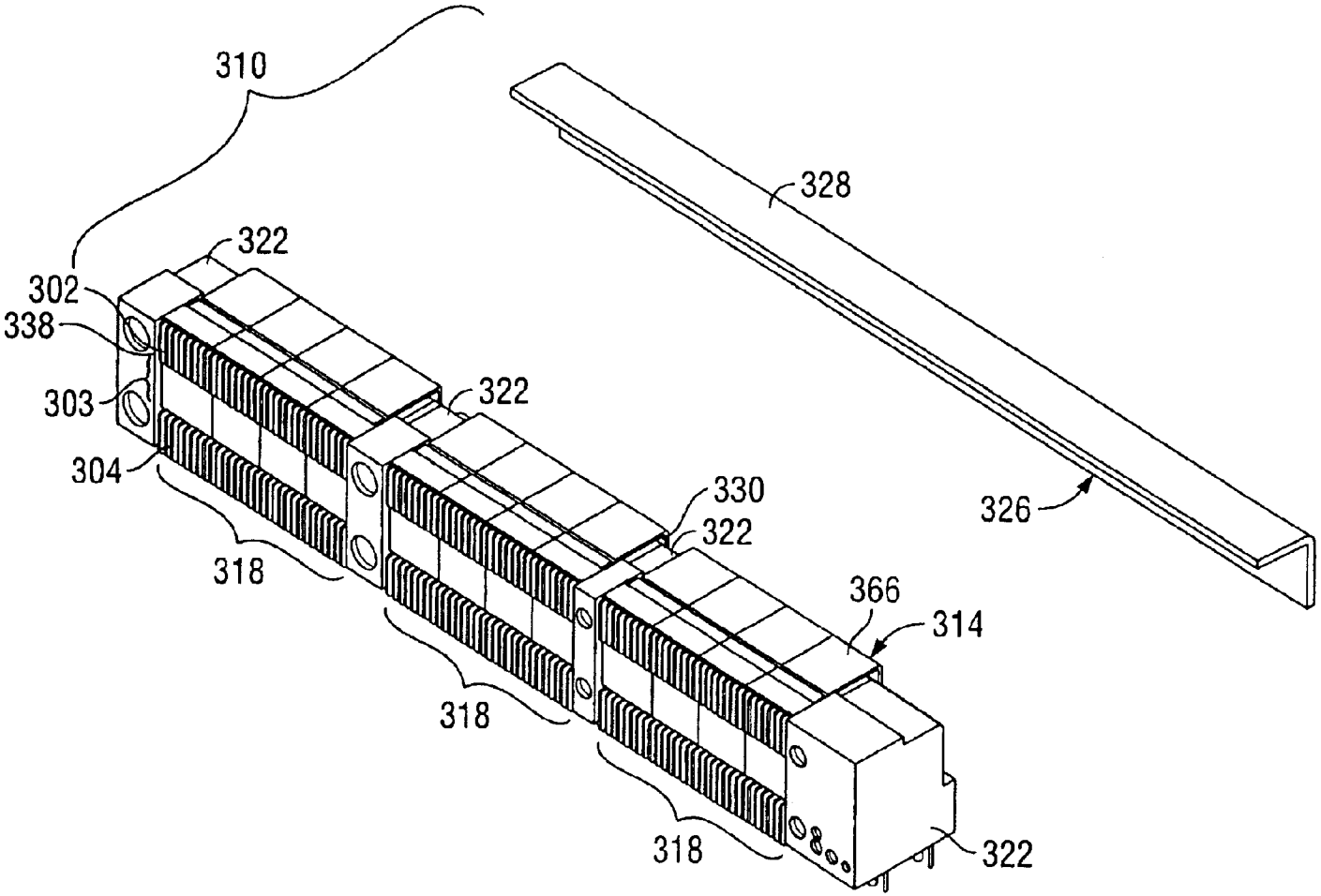
FIG. 9 illustrates a partially exploded view of a card connector assembly formed according to an embodiment of the present invention.

FIG. 9 illustrates a partially exploded view of a card connector assembly 310 formed according to an alternative embodiment of the present invention. The card connector assembly 310 includes multiple connector sections 318 separated by guide blocks 322. Multiple connector modules 314 are provided in each connector section 318. The upper and lower sections 302 and 304 of each wafer 338 are separated by a gap 303 that is larger than the spacing between the upper and lower sections 102 and 104 (FIG. 5). The card connector assembly 310 may be used with a backplane connector assembly 42 (FIG. 2) that includes several upper and lower backplane connectors 46 and 48 (longer than shown in FIG. 2). The upper organizers 366 of the connector modules 314 have flat top walls 330. A large stiffening bar 326 with a planar top beam 322 is fastened to the guide blocks 322 to secure and reinforce all of the connector modules 314 and guide blocks 322 together. The entire card connector assembly 310 may then be press fitted to a daughter card 18 (FIG. 1) with minimal displacement or bowing of the wafers 338, contacts 90 (FIG. 4), or guide blocks 322. The stiffening bar 326 also reinforces the wafers 338 as the wafers 338 are being inserted into the slots 54 (FIG. 2) of the upper and lower backplane connectors 46 and 48.

Figure 10:
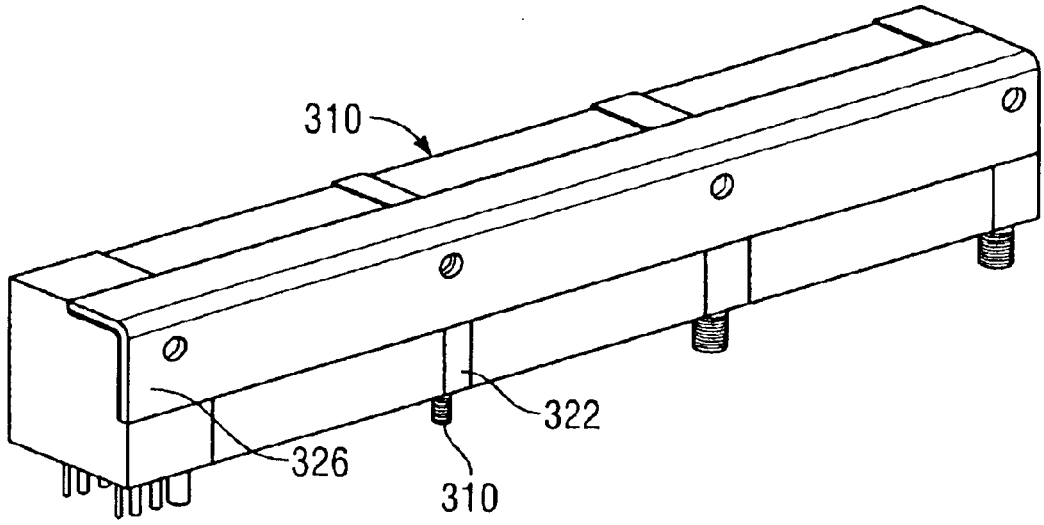
FIG. 10 illustrates a rear isometric view of the card connector assembly of FIG. 9.

FIG. 10 illustrates a rear isometric view of the card connector assembly 310 of FIG. 9. The stiffening bar 326 is secured to the card connector assembly 310 such that the card connector assembly 310 may be connected to a daughter card 18 (FIG. 1). The guide blocks 322 have bolts 310 that are received within the daughter card 18 to secure the card connector assembly 310 to the daughter card 18.

In an alternative embodiment, the upper and lower mating faces 158 and 162 of the shroud 74 (and thus the upper and lower sections 102 and 104 of the wafer 38) may be separated by any number of different vertical distances to accommodate differently spaced parallel upper and lower backplane connectors 46 and 48. Optionally, the shroud 74 may have more than two mating faces and the wafers 38 may have more than two sections in order to accommodate more than two backplane connectors. Optionally, the shroud 74 may not have a spacer block 174 separating mating faces, rather the front card edges 98 of the wafers 38 without notches 106 may extend through the shroud 74 and engage the slots 54 of the upper and lower backplane connectors 46 and 48.

The card connector assembly of the various embodiments provides several benefits. The use of a single set of wafers and a single connector module to connect a single daughter card to multiple backplane connectors eliminates the need to use two separate card connector modules attached to two separate daughter cards. The use of a single connector module is much less complex and requires fewer interconnecting parts and less alignment of parts with different tolerances. Because the connector module involves fewer and simpler parts, the connector module is cheaper and easier to assemble. Thus, the power and data signals travel more efficiently between the daughter card and backplane board.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector comprising:

a housing having first and second sides configured to be joined to first and second circuit boards, respectively; and a wafer held in said housing, said wafer having first and second card edges and having electrical traces extending between said first and second card edges, said first card edge having upper and lower sections configured to be received in separate and distinct upper and lower connectors attached to the first circuit board.

2. The electrical connector of claim 1, wherein said first and second card edges are oriented orthogonally with respect to one another.

3. The electrical connector of claim 1, wherein said electrical traces of said wafer are configured to join the second circuit board with both of the upper and lower connectors attached to the first circuit board.

4. The electrical connector of claim 1, wherein said upper and lower sections of said wafer are separated by a notch.

5. The electrical connector of claim 1, wherein said housing includes a shroud having upper and lower channels extending across a width of said shroud, said upper and lower channels being separated by an insulated spacer and receiving said upper and lower sections of said first card edge, respectively.

6. The electrical connector of claim 1, further comprising a plurality of said wafers, and wherein said housing includes a shroud having a plurality of slots therethrough, said slots extending in a direction parallel to an orientation of said wafers, each of said slots receiving a corresponding one of said first card edges.

7. The electrical connector of claim 1, wherein said wafer includes a notch that divides said upper and lower sections of said first card edge.

8. The electrical connector of claim 1, wherein said housing carries a plurality of said wafers aligned parallel to each other and wherein said upper sections of said wafers are configured to be received in the upper connector and said lower sections of said wafers are configured to be received in the lower connector, the upper and lower connectors being mountable on the first circuit board.

9. The electrical connector of claim 1, wherein said wafer includes contact pads along said first and second card edges, said electrical connector further comprising contacts mating with said contact pads.

10. An electrical connector configured to mate with at least two separate and distinct connectors mounted on a common circuit board, comprising:

a housing having a first side configured to be mounted to the common circuit board;

a wafer held in said housing, said wafer having a first card edge located proximate said first side of said housing; and a shroud mounted to said housing, said shroud having at least one mating interface configured to receive the at least two separate and distinct connectors mounted on the common circuit board.

11. The electrical connector of claim 10, wherein said shroud includes upper and lower channels extending across a width of said shroud transverse to an orientation of said wafer, said upper and lower channels being separated by an insulated spacer and receiving said first card edge, said upper and lower channels being configured to receive the two separate and distinct connectors mounted on the common circuit board.

12. The electrical connector of claim 10, wherein said shroud includes a slot extending in a direction parallel to an orientation of said wafer, said slot receiving said first card edge, said slot extending through two separate transverse channels in said shroud.

13. The electrical connector of claim 10, wherein said wafer includes a notch that divides said first card edge into upper and lower sections that are configured to be received separately by the two separate and distinct connectors mounted on the common circuit board.

14. The electrical connector of claim 10, wherein said housing carries a plurality of said wafers aligned parallel to each other, said wafers having upper and lower sections, each of said upper and lower sections being configured to be received separately in the two separate and distinct connectors mounted on the common circuit board.

15. The electrical connector of claim 10, wherein said shroud includes upper, intermediate and lower walls traversing a width of said shroud, said upper and intermediate walls forming a first channel therebetween, said intermediate and lower walls forming a second channel therebetween, said first and second channels being configured to receive separate and distinct connectors mounted on the common circuit board.

16. An electrical connector assembly, comprising:

an upper connector and a lower connector separate and distinct from said upper connector, said upper and lower connectors configured to be mounted to a first circuit board;

an orthogonal connector configured to be mounted to a second circuit board, said orthogonal connector having a face mating with both of said upper and lower connectors; and a wafer held in said orthogonal connector, said wafer having a first card edge with upper and lower sections joining said upper and lower connectors, respectively when said orthogonal connector is mated with said upper and lower connectors.

17. The electrical connector of claim 16, wherein said orthogonal connector includes a shroud having upper and lower channels extending across a width of said shroud, said upper and lower channels receiving said upper and lower sections of said first card edge, respectively.

18. The electrical connector of claim 16, wherein said orthogonal connector includes a shroud having a slot extending in a direction parallel to an orientation of said wafer, said slot receiving said first card edge.

19. The electrical connector of claim 16, wherein said wafer includes a notch that divides said upper and lower sections of said first card edge.

20. The electrical connector of claim 16, wherein said orthogonal connector carries a plurality of said wafers aligned parallel to each other, each of said upper sections of said wafers being received in said upper connector, each of said lower sections of said wafers being received in said lower connector.

* * * * *